United States Patent [19]

Hacker et al.

[11] Patent Number: 4,667,416

[45] Date of Patent: May 26, 1987

[54] DEVICE FOR DRYING ORGANIC SOLIDS OF HIGH WATER CONTENT

[75] Inventors: Hermann Hacker, Deutschlandsberg; Pavle Ivanovski, Linz; Peter Herber, Zwettl, all of Austria

[73] Assignee: Voest-Alpine Aktiengesellschaft, Austria

[21] Appl. No.: 622,247

[22] Filed: Jun. 19, 1984

[30] Foreign Application Priority Data

Jun. 30, 1983 [AT] Austria ..... 2409/83

[51] Int. Cl.[4] ..... F26B 3/00

[52] U.S. Cl. ..... 34/9; 34/15; 34/35; 34/36; 34/86

[58] Field of Search ..... 34/9, 15, 22, 35, 36, 34/69, 86, 168

[56] References Cited

U.S. PATENT DOCUMENTS

| | | | |
|---|---|---|---|
| 1,679,078 | 7/1928 | Fleissner | 34/15 |
| 3,007,254 | 11/1961 | Schuster | 34/35 |
| 4,441,260 | 4/1984 | Nakabayashi et al. | 34/35 |
| 4,466,199 | 8/1984 | Nakabayashi et al. | 34/15 |
| 4,472,885 | 9/1984 | Nakabayashi et al. | 34/15 |

FOREIGN PATENT DOCUMENTS 276256 11/1969 Austria .

*Primary Examiner*—Albert J. Makay
*Assistant Examiner*—David W. Westphal
*Attorney, Agent, or Firm*—Cushman, Darby & Cushman

[57] ABSTRACT

In a device for drying organic solids of high water content, particularly brown coals, the embodiment is effected in order to simplify the preliminary heating with steam in such a way that the overflow lines (7) with shutoff device end in the vapor space of the attached vessels (8) and dampers (2). The ending of the overflow lines (7) is conveniently shaped as collecting funnel (FIG. 1).

1 Claim, 2 Drawing Figures

DEVICE FOR DRYING ORGANIC SOLIDS OF HIGH WATER CONTENT

Figure 1:
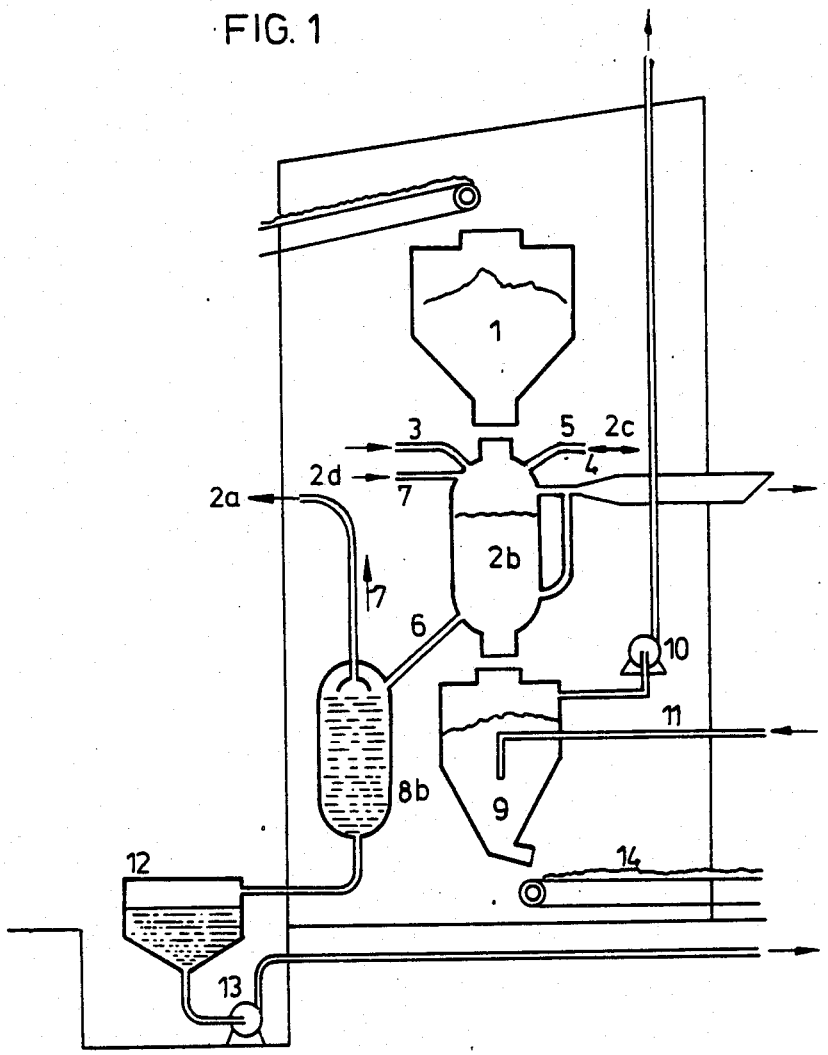

The invention relates to a device for drying organic solids of high water content, particularly brown coals, with at least two dampers resistant to pressure, at least two attached vessels and conduits for the supply and exhaust of steam and waste water and overflow lines with shutoff device between attached vessel and dampers.

Such a device can for instance be taken from the AT-PS 287 648. In this well known embodiment the content of the attached vessels was conducted by an immersion tube and a rising main attached to it into an intermediate container and there was stored without pressure, the steam formed with the expansion of the hot water being conducted into the raw coal bunker. Preliminary heating by means of steam of the organic solids to be dried is already to be taken from the AT-PS 366 O89 in which also the use of steam formed in the drying process for this preheating is mentioned.

The invention is designed to develop a constructionally very simple embodiment of the well known devices with which preheating of the material to be dried introduced into the damper can be effected directly without additional intermediate or expansion vessels. In order to solve this problem the invention consists essentially in the overflow lines with shutoff device having their source in the vapour space of the attached vessels between attached vessels and dampers. In such an embodiment steam can be taken directly from an attached vessel owing to the suitable valve adjustment and be used for preheating the organic material of high water content introduced into a damper. The required changes are thus confined solely to the development of the ending of the overflow line in the attached vessels, which so far was usually shaped as immersion tube. Steam running over from an attached vessel into an adjacent damper, expansion of the hot waste water being under high pressure occurs simultaneously in the attached vessel, and thus the content of the attached vessel is evaporated partially corresponding to the thermal potential available and can be also used for preheating the organic solids in an adjacent damper. Due to the direct passing over of steam from an attached vessel to an adjacent damper for the purpose of preheating the organic solids the heat balance is improved and losses of heat are diminished.

At the end of the passing over of steam, i. e. after pressure balance has set in the valve in the overflow line between the attached vessel and adjacent damper is shut.

Complete expansion of the residual pressure in the damper assembly consisting of a damper and an attached vessel being in the second expansion stage is effected by opening the blowout valve belonging to this damper. In this a suitably quick decrease in pressure is achieved by the fact that the blowout valve is inserted in a blowoff line which is connected with the upper and the lower part of the damper as well as with the vapour space of the attached vessel. Draining off of the residual water in the attached vessel is effected directly after blowing out by opening its bottomvalve.

In the adjacent damper being in the first stage of preheating the blowout valve remains shut. The bottom valve of the attached vessel belonging to this damper remains also shut. Thus the residual pressure after condensation of the steam passing over is preserved and can thus be of advantage to a better heating of the content.

The subsequent second preheating starts thus from a higher level of temperature and pressure, so that also the consumption of live steam in the following steaming stage can be diminished.

As the valve in the overflow line between attached vessel and adjacent damper need not be shaped—as until now—for muddy hot water, a smaller section of the overflow line and a smaller valve in this line may be sufficient. In addition to that, also durability of the valves is increased, as they are charged only with steam.

Conveniently, the overflow line has its source at the highest point of the attached vessel above the maximum liquid level.

The invention is subsequently explained more precisely with the aid of embodiments described in the diagrams. In these FIG. 1 shows a schematic representation of the process diagram of a coal drying plant according to Fleissner and FIG. 2 a correspondingly elaborated schematic representation of an installation with an assembly of four dampers.

In FIG. 1 the coal charge bunker is marked with 1. By this coal charge bunker the coal gets into one of the dampers 2, viz. **2*b*, which is developed as an autoclave. To this damper 2*b* a live steam supply 3, a blowoff line 4, an overflow line (damper 2*b*–damper 2*c*) 5, a waste water disposal line 6 and an overflow line (attached vessel 8*b*–damper 2*a*) 7 are connected The waste water disposal line ends in an attached vessel 8, viz. 8*b*. The overflow line 7 between attached vessel 8*b* and a contiguous damper 2*a* has its source above the maximum liquid level in the attached vessel 8*b*. For preliminary heating of coal introduced into the autoclave, or damper 2*a* steam is supplied from the contiguous attached vessel 8*b* and damper 2*b* by overflow line 7, the hot waste water being under pressure in the attached vessel 8*b* being partially evaporated and this steam getting onto the damper 2*a*** likewise.

A post-ventilation bunker for dried coal to which a vapour exhaust 10 and a post-ventilation line 11 are connected is marked with 9.

To the attached vessel **2*b* a waste water container 12 with waste water pump 13 is connected. The dried coal brought out from the post-ventilation bunker is carried away by a conveyor belt 14**.

Figure 2:
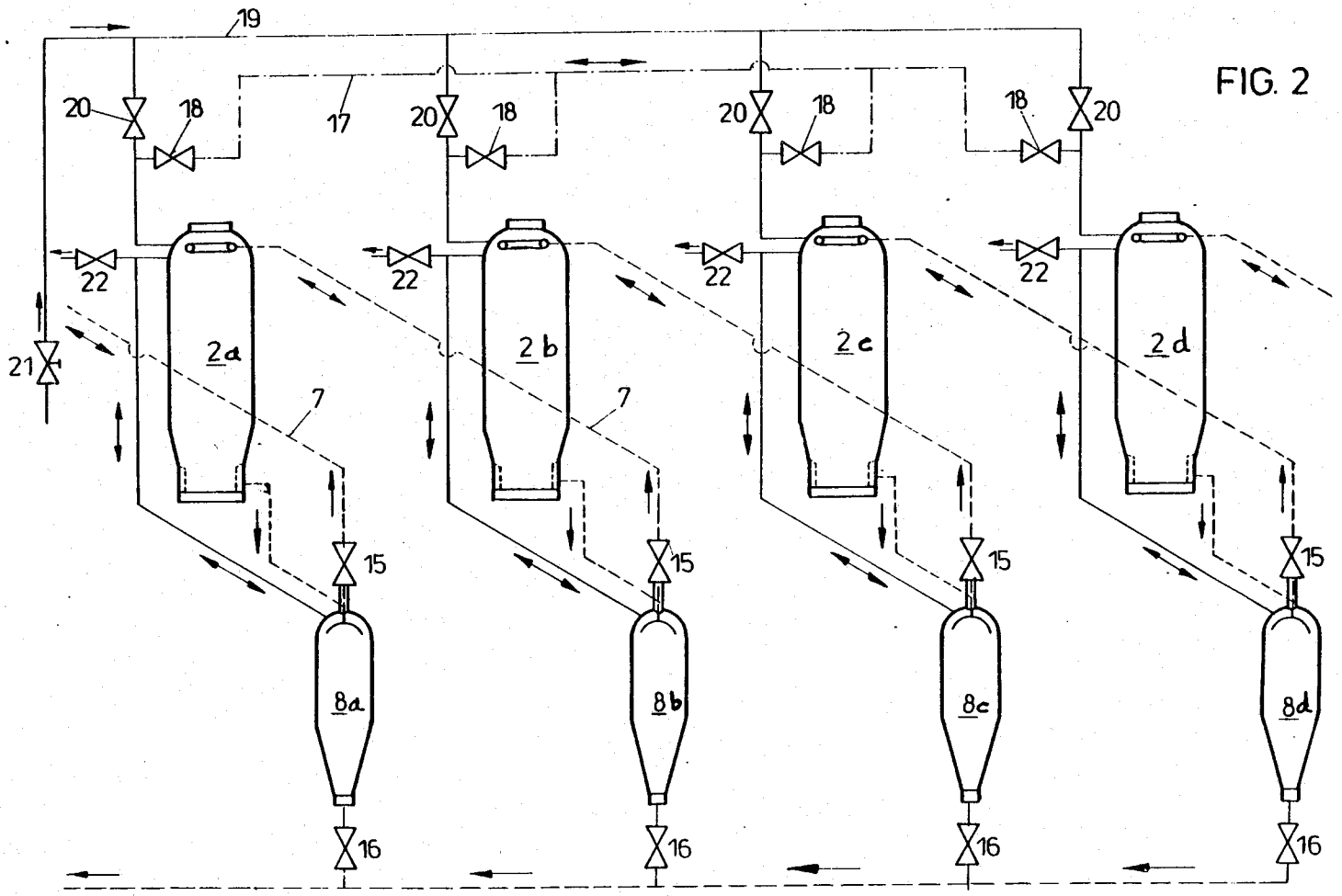

In the embodiment according to FIG. 2 four dampers **2*a*, 2*b*, 2*c* and 2*d*, are arranged side by side in an assembly. The attached vessels are marked with 8*a*, 8*b*, 8*c* and 8d. The overflow lines 7 are fitted with shutoff valves 15. The bottom valves of the attached vessels 8*a*–8*d* are marked with 16. The dampers 2*a*–2*d* can be linked to each other by the overflow lines 5 and 17 and by control mechanism of the corresponding valves 18. The live steam supply into the dampers 2*a*–2*d* is achieved from a collecting line 19 by actuation of valves 20 by live steam lines 3, the main shutoff valve for live steam being marked with 21**.

Also in this embodiment preheating of the charged coal can he effected directly in the damper using vapour. To this purpose valve 15 of an attached vessel **8*b* (the corresponding damper 2*b* of which being in the second expansion stage) and by the overflow line 7 steam is supplied to that damper 2*a*, in which the first preheating of coal shall be effected. The bottom valves 16 of the attached vessels 8*a* and 8*b* remain shut during this process. Also the hot water collected in attached vessel 8*b* is partially evaporated by expansion during this process. The steam passing over from the attached vessel 8***b* is condensed to a wide extent in the contiguous damper 2*a* filled with cold coal and collects in the form of waste water on the bottom of the attached vessel 2*a* belonging to this damper.

For diminishing residual pressure which is necessary to empty the damper 2*b* from dry coal safely, shortly after pressure balance valve 15 in the overflow line 7 between attached vessel 8*b* and damper 2*a* is shut and before finishing the second expansion stage in the damper 2*b* its blowout valve 22 in the blowoff line 4 is opened, which is connected with the upper and the lower part of the damper 2*b* and the vapour space of attached vessel 8*b* in order to ensure a complete expansion of the system damper 2*b*–attached vessel 8*b*.

Subsequently also bottom valve 16 of the attached vessel 8*b* is opened Thus the non condensed residual vapour is exhausted by blowoff line 4 either directly or by an expansion vent and the waste water from the attached vessel 8*b* is lead after pressure diminishing into the mud container 12 nearly without pressure During the first preheating of the charged coal blowoff valve 22 in the damper 2*a* and bottom valve 16 in the corresponding attached vessel 8*a* remain shut.

What is claimed is:

1. A method for drying organic solids of high water content, particularly brown coal in an apparatus comprising a plurality of adjacent autoclaves and a plurality of adjacent vessels, each autoclaves and a plurality of adjacent vessels, each autoclave being connected by a conduit to a respective vessel, each vessel having a vapor space in the upper portion of the vessel and an overflow line from said vapor space of each vessel to an adjacent autocalve, the method comprising transferring coal to one of the autoclaves, supplying steam to said one autoclave to dry the solids therein, transferring the resulting waste water through the conduit from said one autoclave to the respective vessel, and transferring only steam from said vapor space to an adjacent autoclave to preheat a second coal charge in the adjacent autoclave.

* * * * *